United States Patent [19]

Giancaterino

[11] 4,143,896

[45] Mar. 13, 1979

[54] LOCK ACTUATOR

[76] Inventor: Domenic Giancaterino, 13 Wahnita Rd., Worcester, Mass. 01606

[21] Appl. No.: 852,668

[22] Filed: Nov. 18, 1977

Related U.S. Application Data

[63] Continuation of Ser. No. 736,960, Oct. 29, 1976, abandoned.

[51] Int. Cl.[2] ..... E05C 13/04

[52] U.S. Cl. ..... 292/347; 292/1

[58] Field of Search ..... 85/56; 292/336.3, 347, 292/1

[56] References Cited

U.S. PATENT DOCUMENTS

| | | | |
|---|---|---|---|
| 1,576,413 | 3/1926 | Cubitt | 85/1 SS X |
| 2,793,064 | 5/1957 | Budoff | 292/347 X |
| 3,790,199 | 2/1974 | Ballou | 292/336.3 |

*Primary Examiner*—Richard E. Moore

*Attorney, Agent, or Firm*—Norman S. Blodgett; GerryA. Blodgett

[57] ABSTRACT

Actuator for automotive door lock consisting of a main body having a smooth cylindrical surface adapted to fit in a door sill opening and a threaded bore extending inwardly from one end for attachment to a threaded lock rod.

3 Claims, 7 Drawing Figures

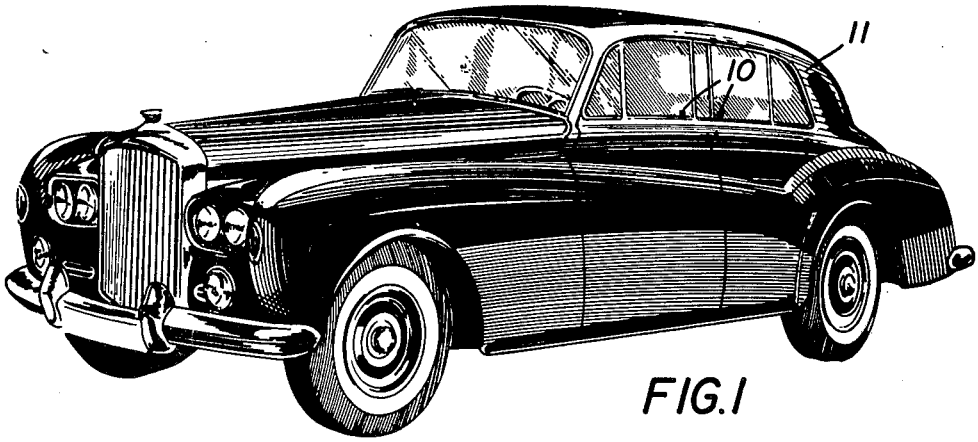
FIG.1
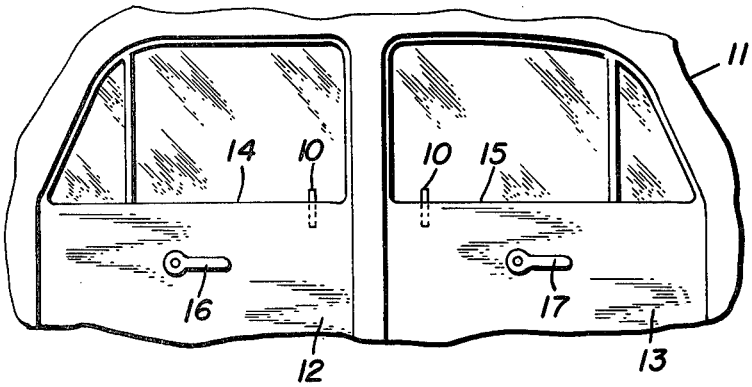
FIG.2
FIG.4
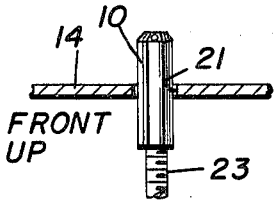
FIG.6
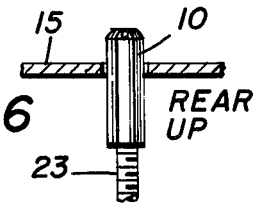
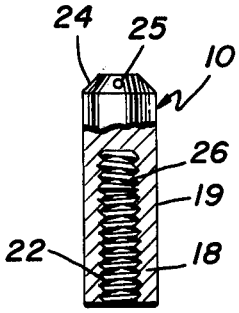
FIG.3
FIG.5
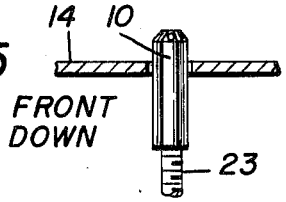
FIG.7
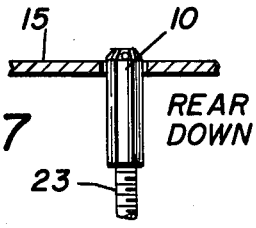

LOCK ACTUATOR

This is a continuation of application Ser. No. 736,960 filed Oct. 29, 1976 now abandoned.

BACKGROUND OF THE INVENTION

One of the major problems is the automotive field at the present time is the unauthorized entry into motor vehicles. Such entry can take place for one of three reasons, i.e., (1) to start up the engine and steal the vehicle, (2) to steal articles of personal property from the interior of the vehicle, and (3) to commit vandalism on the interior. It is a relatively simple matter for a thief to unlock the conventional automobile which uses plunger-type locks on the door; he simply passes a wire loop over the top of the window and down the inside of the window and over the plunger. Since the conventional plunger has a large knob at the top, once the loop has passed over this under the body of the plunger, he simply pulls upwardly on the wire and the plunger is pulled upwardly thus unlocking the door. These and other difficulties experienced with the prior art devices have been obviated in a novel manner by the present invention.

It is, therefore, an outstanding object of the invention to provide a lock plunger which makes it difficult to unlock an automobile door from the exterior.

Another object of this invention is the provision of an automobile lock plunger that is difficult for small children to use.

A further object of the present invention is the provision of a lock plunger which is intended as a replacement for a conventional lock plunger of an automobile in order to protect the automobile from unwanted intrusion.

It is another object of the instant invention to provide a lock actuator which is simple in construction, which is inexpensive to manufacture, and which is capable of a long life of useful service with a minimum of care.

With these and other objects in view, as will be apparent to those skilled in the art, the invention resides in the combination of parts set forth in the specification and covered by the claims appended hereto.

SUMMARY OF THE INVENTION

In general, the invention consists of an automotive lock plunger having a smooth, cylindrical outer surface adapted to fit in a window sill opening and having a threaded bore which extends inwardly from one end for attachment to a threaded lock rod.

More specifically a frusto-conical extension is provided at the other end and a small transverse bore enters the frusto-conical extension. A threaded plug is provided for threaded engagement with the threaded to bore to determine the height of the plunger above the threaded lock rod and the sill.

BRIEF DESCRIPTION OF THE DRAWINGS

The character of the invention, however, may be best understood by reference to one of its structural forms, as illustrated by the accompanying drawings, in which:

FIG. 1 is a perspective view of an automobile incorporating the features of the present invention, FIG. 2 is an elevational view of the interior of the automobile showing front and rear doors using the lock plunger of the invention, FIG. 3 is an elevational view of a lock plunger with a portion broken away to show the interior, and FIGS. 4–7 are schematic views showing various conditions of the lock actuator.

DESCRIPTION OF THE PREFERRED EMBODIMENT

Referring first to FIG. 1, which best shows the general features of the invention, it can be seen that lock plungers, indicated generally by the reference numberal 10, are shown in use with the doors of an automobile 11.

In FIG. 2 it can be seen that a lock plunger 1 has been applied to the rear corner of a front door 12 and protudes from its sill 14. A similar lock plunger has been applied to the front corner of a sill 15 of a rear door 13. The front door 12 is provided on the interior with a handle 16 with which the door can be opened from the inside, even when the plunger is in its lower or "locked" position. The rear door is provided with a handle 17 which in many automobiles is capable of unlocking the door only when the plunger is in the "up" or "unlocked" position. This is because children so often ride in the rear portion of the automobile and this prevents them from opening the door while it is moving.

In FIG. 3 it can be seen that the lock plunger 10 is provided with a main body 18 which in the preferred embodiment is formed of aluminum. This main body is provided with a smooth cylindrical outer surface 19. The cylindrical surface is circular in cross-section and of a size to fit smoothly through the conventional round opening in the sill of the door. A threaded bore 22 is formed in one end for connection to a threaded vertical lock rod in the interior of the door. The other end is provided with a frusto-conical extension 24 into which extends a small pin-sized transverse bore 25. A threaded plug 26 is threadedly carried in the bore 22 and occupies the inner portion thereof to limit the depth by which the lock rod extends into the bore. This plug may or may not be used, depending on the circumstances, as will be described more fully hereinafter.

The operation of the invention will now be readily understood in view of the above description and particularly with regard to FIGS. 4, 5, 6 and 7. In the case of the front door 12, the plunger which is provided original equipment with the automobile is removed by unscrewing it from the threaded lock rod 23 and it is replaced by the plunger 10 of the invention. The plunger is threaded onto the upper end of the rod 23 and, in the "unlocked" position, it rises substantially through the aperture 21 in the sill 14 and extends above the sill a substantial distance. In this "unlocked" position the door is free to be opened by use of the handle 16. In FIG. 5 the plunger 10 is shown in its lower position brought about by pushing it downwardly; this movement pushes the rod 23 downwardly and locks the door. This is the down or "locked" position for the front door. The door can still be opened by operating the handle 16, but because of the cylindrical surface 19 being perfectly smooth and the frusto-conical extension 24 providing no gripping surface, it is impossible for a non-authorized person to insert a loop wire over the window and reach down to pull the plunger upwardly. In the case of the rear door, because of the fact that it is not possible in many cases to unlock the door by using the handle 17, the plug 23 is removed from the threaded bore, so that the plunger extends further down the threaded lock rod 23. In the "up" position, shown in FIG. 6, the plunger extends above the sill 15 a short distance. When it is in the "down" position shown in FIG. 7, however, it is almost flush with the sill 15. Only the small aperture 25 is located above the sill. In that position the door is locked and it is impossible for a would-be thief to pull up on the door on the plunger, nor can a child do so. Only by the deliberate use of a pin inserted in the small bore 25 can it be lifted. This takes a deliberate action of an adult (either from the front seat or the rear seat) to do so. In the case of the front door the plunger is allowed, (even the "down" position shown in FIG. 5) to reside a slight distance above the sill. In that case, a person using his fingers can pull the plunger up or, if he has difficulty, a small pin in the aperture 25 will accomplish the same purpose. In the case of the "down" position of the rear door plunger as shown in FIG. 7, however, it is not possible to lift it with the fingers and the pin must always be used. Thus, so far as the rear set is concerned, neither a child nor an unauthorized person can unlock the rear door.

It is clear, then, that the present invention provides perfect protection against the type of unauthorized entry that has been described above. The conversion can be made inexpensively by the provision of a kit consisting of four of the lock plungers 10 of the invention; usually a small pin having a loop at one end which can be carried on a keychain is also provided. In installing the new plungers, one first removes the present knobs from the doors and then measures the new knob to the proper height. If it appears that the new plungers do not go to a level of about a quarter of an inch above the window sill in the case of the front doors and slightly above the window sill as in the case of the rear doors, it may be necessary to cut the screw spindle or rod 23. In order to do this a nut of the same thread is screwed down on the rod and this is used as a guide for the use of a hacksaw. After the bolt is cut off above the nut, the nut is removed and this will smooth burrs from the thread. It is necessary, in placing the new plunger in the car, to make sure that the bore 25 faces interiorly of the car, so that is is available from the interior.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Lock actuator for automobile door, comprising a main body having a smooth cylindrical surface adapted to fit in a door sill opening, a threaded bore extending inwardly from one end for attachment to a threaded lock rod, a short frusto-conical extension being integrally formed at the other end, and a small transverse bore being provided at the other end, and a small transverse bore being provided at said other end.

2. Lock actuator as recited in claim 1, wherein said bore extends through said extension.

3. Lock actuator as recited in claim 1, wherein a threaded plug is threadedly carried in the bore and occupies the inner portion thereof to limit the depth to which the lock rod extends into the bore.

* * * * *